US006160542A

United States Patent [19]

Hwang

[11] Patent Number: 6,160,542

[45] Date of Patent: Dec. 12, 2000

[54] TRACKING CONTROL CIRCUIT OF A DISPLAY

[75] Inventor: Ho-Dae Hwang, Seoul, Rep. of Korea

[73] Assignee: SamSung Electronics Co., Ltd., Suwon, Rep. of Korea

[21] Appl. No.: 09/204,345

[22] Filed: Dec. 4, 1998

[30] Foreign Application Priority Data

Dec. 6, 1997 [KR] Rep. of Korea ..... 97-66532

[51] Int. Cl.[7] ..... G09G 5/00

[52] U.S. Cl. ..... 345/213; 345/211; 345/212

[58] Field of Search ..... 345/87, 94, 211, 345/212, 213, 98

[56] References Cited

U.S. PATENT DOCUMENTS

| | | | |
|---|---|---|---|
| 4,223,392 | 9/1980 | Lemaire et al. . | |
| 4,290,022 | 9/1981 | Puckette . | |
| 4,594,516 | 6/1986 | Tokumitsu . | |
| 4,757,264 | 7/1988 | Lee et al. . | |
| 4,772,937 | 9/1988 | Romesburg . | |
| 4,839,726 | 6/1989 | Balopole et al. . | |
| 4,851,910 | 7/1989 | Kawai et al. . | |
| 4,864,401 | 9/1989 | Kawata et al. . | |
| 4,998,169 | 3/1991 | Yoshioka . | |
| 5,012,239 | 4/1991 | Griebeler . | |
| 5,359,366 | 10/1994 | Ubukata et al. . | |
| 5,420,895 | 5/1995 | Kim . | |
| 5,475,440 | 12/1995 | Kobayashi et al. . | |
| 5,610,621 | 3/1997 | Itoh et al. | 345/213 |
| 5,663,767 | 9/1997 | Rumreich et al. . | |
| 5,675,832 | 10/1997 | Ikami et al. . | |
| 5,692,201 | 11/1997 | Yato | 359/750 |
| 5,710,570 | 1/1998 | Wada et al. | 345/213 |
| 5,751,278 | 5/1998 | Inamori et al. | 345/211 |
| 5,990,857 | 11/1999 | Kubota et al. | 345/98 |
| 6,011,533 | 1/2000 | Aoki | 345/92 |

*Primary Examiner*—Richard A. Hjerpe
*Assistant Examiner*—Kimnhung Nguyen
*Attorney, Agent, or Firm*—Robert E. Bushnell, Esq.

[57] ABSTRACT

A display includes: a clock signal generator for generating a first sampling clock signal used for converting an analog video signal supplied from a host to a digital video signal; a tracking control circuit for generating tracking control data corresponding to a tracking adjustment key input; an A/D converter for converting the analog video signal to the digital video signal in synchronism with a second clock signal obtained by delaying the first sampling clock signal according to the tracking control data; a high frequency clock signal generator for generating a high frequency clock signal, and the tracking control circuit measuring the presently delayed time of the second sampling clock signal by means of the high frequency clock signal so as to adjust the delayed time according to the tracking control data.

14 Claims, 6 Drawing Sheets

TRACKING CONTROL CIRCUIT OF A DISPLAY

CLAIM OF PRIORITY

This application makes reference to, incorporates the same herein, and claims all benefits accruing under 35 U.S.C. §119 from an application for TRACKING CONTROL CIRCUIT OF A FLAT PANEL DISPLAY earlier filed in the Korean Industrial Property Office on Dec. 6, 1997 and there duly assigned Ser. No. 66532/1997.

BACKGROUND OF THE INVENTION

1. Field of the Invention

The present invention concerns a display, and more particularly a tracking control circuit of a display. The display may be a flat panel display.

2. Description of the Related Art

An earlier display displays a digital video signal converted from an analog video signal supplied by a host such as a personal computer system. In this case, the analog video signal from the host is firstly amplified by an amplifier, and converted into the digital video signal through an analog-to-digital converter, which performs sampling operations on the analog video signal in synchronism with a second sampling clock signal. The second sampling clock signal is obtained by properly delaying a first sampling clock signal supplied from a clock generator by means of a tracking control circuit, which adjusts the delaying time according to a tracking control signal supplied from a microcomputer.

The tracking control circuit includes a plurality of buffers for delaying the first sampling clock signal, and a multiplexer for selecting one of the outputs of the buffers to generate the second sampling clock signal according to the tracking control signal.

The microcomputer generates a horizontal synchronizing signal having a particular polarity according to the horizontal synchronizing signal received from the host. For example, if the flat panel display is characteristically operated in synchronism with a synchronizing signal of negative polarity, the microcomputer generates the horizontal synchronizing signal of negative polarity. The clock signal generator generates the first sampling clock signal of the frequency corresponding to the received horizontal synchronizing signal.

The horizontal synchronizing signal supplied from the host has a frequency varying with the display mode, i.e., resolution. The analog video signal is inputted in synchronism with the horizontal synchronizing signal. Hence, the clock signal generator generates the first sampling clock signal having a frequency according to the display mode. The clock signal generator is generally achieved by using a phase locked loop circuit (PLL circuit).

However, although the clock signal generator generates the first sampling clock signal having a proper frequency for the present display mode, it is very difficult for the A/D converter to perform a correct sampling operation on the analog video signal. For the clock signal generator hardly generates the sampling clock signal proper to each display mode. This requires the tracking control.

The tracking control causes the A/D converter to perform a correct sampling operation on the analog video signal to properly reconstruct the original video signal. This is carried out by the tracking control circuit, which delays the first sampling clock signal of the clock signal generator according to the tracking control signal, supplying it to the A/D converter. The tracking control signal is supplied by the microcomputer according to a tracking adjustment key input made by the user.

Such a tracking control circuit employs a plurality of buffers to perform the delay function. However, the buffers vary the delaying time so as to result in improper conversion of the analog video signal to the digital video signal if they are subjected to an external stress, such as heat, which is common to a flat panel display, for example.

The following patents each discloses features in common with the present invention: U.S. Pat. No. 4,757,264 to Lee et al., entitled Sample Clock Signal Generator Circuit, U.S. Pat. No. 4,851,910 to Kawai et al., entitled Synchronizing Pulse Signal Generation Device, U.S. Pat. No. 4,290,022 to Puckette, entitled Digitally Programmable Phase Shifter, U.S. Pat. No. 4,594,516 to Tokumitsu, entitled Sampling Pulse Generator, U.S. Pat. No. 4,223,392 to Lemaire et al., entitled Clock-Signal Generator For A Data-Processing System, U.S. Pat. No. 5,012,239 to Griebeler, entitled High Resolution Position Sensor Circuit, U.S. Pat. No. 4,839,726 to Balopole et al., entitled Video Enhancement Method And System, U.S. Pat. No. 5,475,440 to Kobayashi et al., entitled Digital Time Base Corrector For Video Signal Reproduction, U.S. Pat. No. 5,359,366 to Ubukata et al., entitled Time Base Correction Apparatus, U.S. Pat. No. 4,864,401 to Kawata et al., entitled Synchronization Signal Generator Without Oscillator, U.S. Pat. No. 4,772,937 to Romesburg, entitled Skew Signal Generating Apparatus For Digital TV, U.S. Pat. No. 5,420,895 to Kim, entitled Phase Compensating Circuit, U.S. Pat. No. 4,998,169 to Yoshioka, entitled Flat-Panel Displays Unit For Displaying Image Data From Personal Computer Or The Like, U.S. Pat. No. 5,675,832 to Ikami et al., entitled Delay Generator For Reducing Electromagnetic Interference Having Plurality Of Delay Paths And Selecting One Of The Delay Paths In Consonance With A Register Value, and U.S. Pat. No. 5,663,767 to Rumreich et al., entitled Clock Re-Timing Apparatus With Cascaded Delay Stages.

SUMMARY OF THE INVENTION

It is an object of the present invention to provide a tracking control circuit of a display which does not vary the prescribed delayed time of the sampling clock signal due to such external factors as heat.

According to an embodiment of the present invention, a display comprises: a clock signal generator for generating a first sampling clock signal used for converting an analog video signal supplied from a host to a digital video signal; a tracking control circuit for generating a tracking control data corresponding to a tracking adjustment key input; an A/D converter for converting the analog video signal to the digital video signal in synchronism with a second clock signal obtained by delaying the first sampling clock signal according to the value of the tracking control data; a high frequency clock signal generator for generating a high frequency clock signal; and the tracking control circuit measuring the presently delayed time of the second sampling clock signal by means of the high frequency clock signal so as to adjust the delayed time according to the value of the tracking control data.

Preferably, the tracking adjustment circuit further includes: a delay measurement circuit for measuring the phase difference between the horizontal synchronizing signal from the host and the second sampling clock signal by means of the high frequency clock signal to generate a phase difference data corresponding to the presently delayed time;

a comparator for comparing the tracking control data with the phase difference data to generate a time adjustment signal to adjust the delayed time by either increasing or decreasing it, a delay data generator for increasing or decreasing the delayed time according to the time adjustment signal to generate delay data, and a delay circuit for delaying the first sampling clock signal according to the delay data to generate the second sampling clock signal.

The delay measurement circuit further includes: a JK flip-flop for receiving the horizontal synchronizing signal as a J-input thereof and the second sampling clock signal as a K-input thereof; a counter enabled by the output of the JK flip-flop to perform the counting operation in synchronism with the high frequency clock signal, and a latch enabled by the output of the JK flip-flop to latch the counting value of the counter applied to the comparator.

The delay data generator further includes an up/down counter for increasing or decreasing the value of the delay data in synchronism with the horizontal synchronizing signal according to a voltage level of the time adjustment signal.

The delay circuit further includes a shift register for shifting the sampling first sampling clock signal in synchronism with the high frequency clock signal, and a multiplexer for selecting one of the output bits of the shift register as the second sampling clock signal according to the delay data.

Thus, the tracking adjustment circuit measures the present delayed time according to the high frequency clock signal to adjust it according to the value of the tracking control data, so that an external influence such as heat may not affect the delaying time, and the A/D converter properly performs the conversion operation.

The present invention will now be described more specifically with reference to the drawings attached only by way of example.

BRIEF DESCRIPTION OF THE ATTACHED DRAWINGS

DESCRIPTION OF THE PREFERRED EMBODIMENTS

Figure 1:
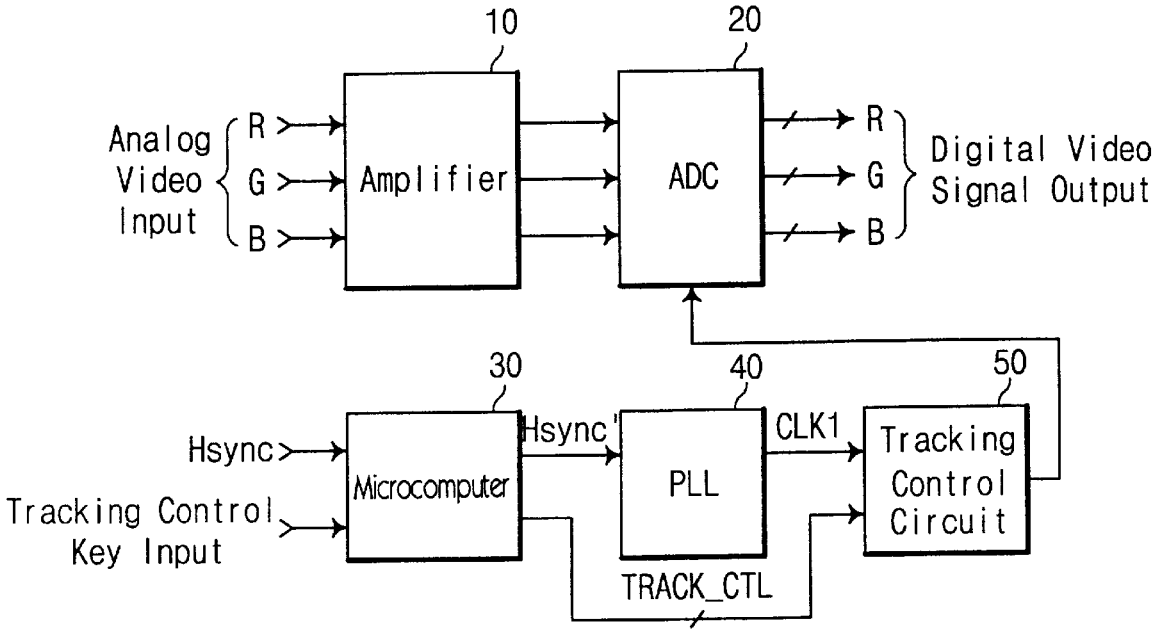
Fig. 1 (Related Art)
FIG. 1 is a block diagram illustrating a portion of the structure of an earlier flat panel display.
Figure 2:
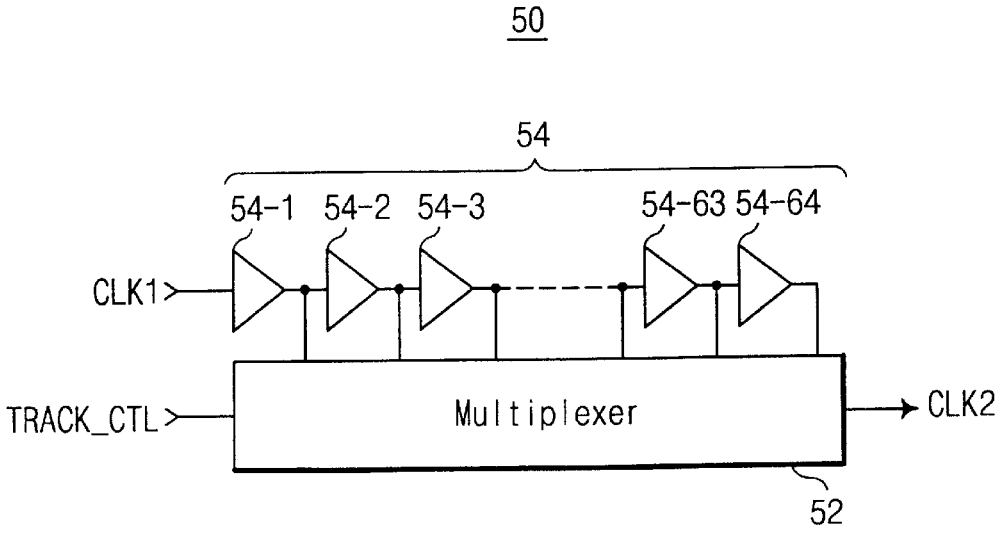
Fig. 2 (Related Art)
FIG. 2 is a detailed circuit diagram illustrating the tracking control circuit shown in FIG. 1.
Figure 3:
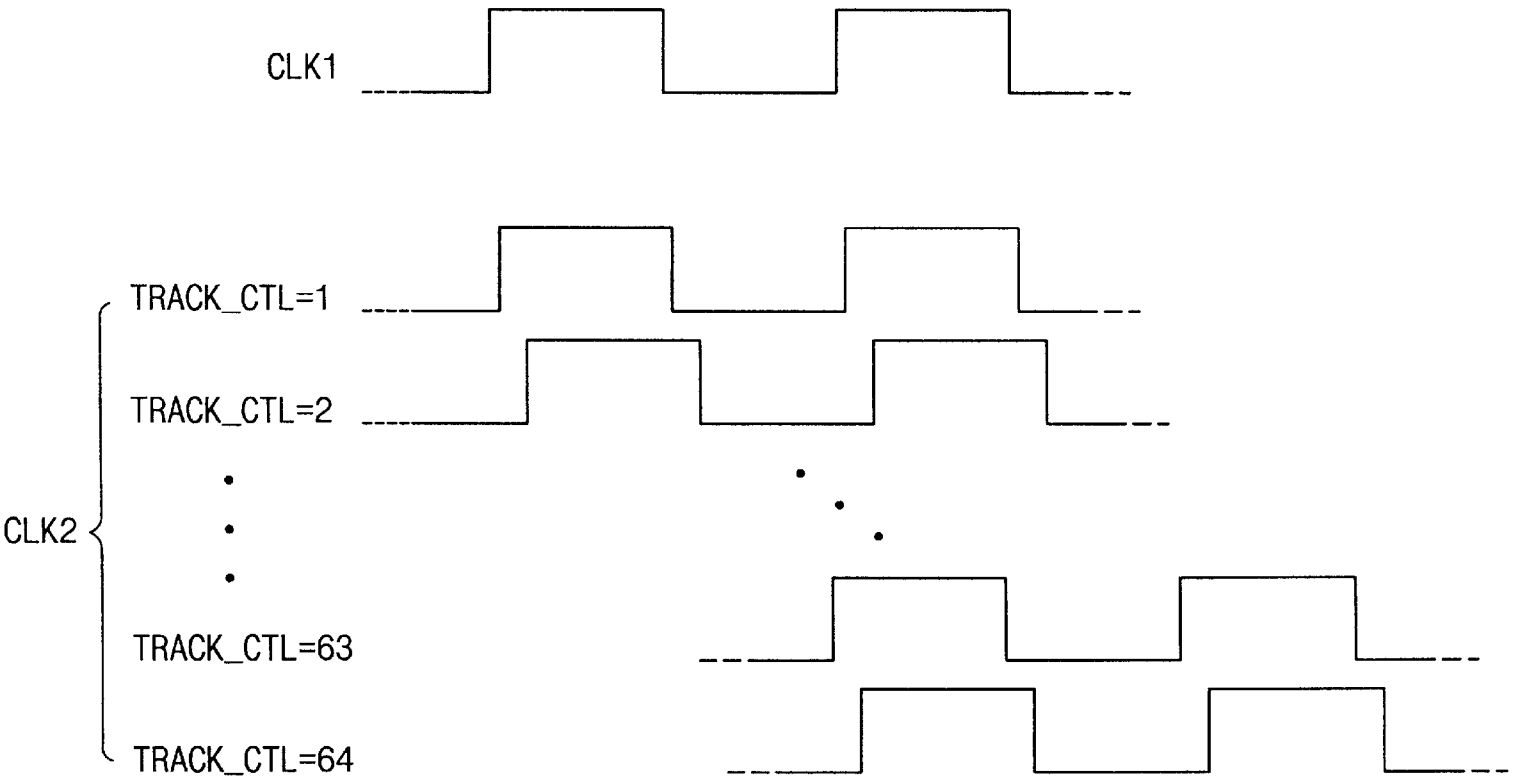
Fig. 3 (Related Art)
FIG. 3 is a timing diagram illustrating the output signal characteristics of the tracking control circuit of FIG. 1 according to the input signal.

FIGS. 1–3 illustrate the display discussed in the Description of the Related Art above.

As shown in FIG. 1, an amplifier 10 receives an analog video input R, G, B and provides an amplified output to the analog to digital converter (ADC) 20 which provides a digital video signal output R, G, B.

A microcomputer 30 receives signals Hsync and the tracking control key input and provides an Hsync' to a phase lock loop circuit PLL 40 and provides a TRACK_CTL to a tracking control circuit 50 which also receives a clock CLK1 from the phase lock loop circuit 40 and provides a control signal for the analog to digital converter 20.

As illustrated in FIG. 2, the tracking control circuit 50 includes a plurality of buffers 54-1 to 54-64 for delaying the clock signal CLK1 and a multiplexer 52 for selecting one of the outputs of the buffers 54-1 to 54-64 to generate the clock signal CLK2 according to the tracking control signal TRACK_CTL.

FIG. 3 illustrates the relationship between the clock signals.

Figure 4:
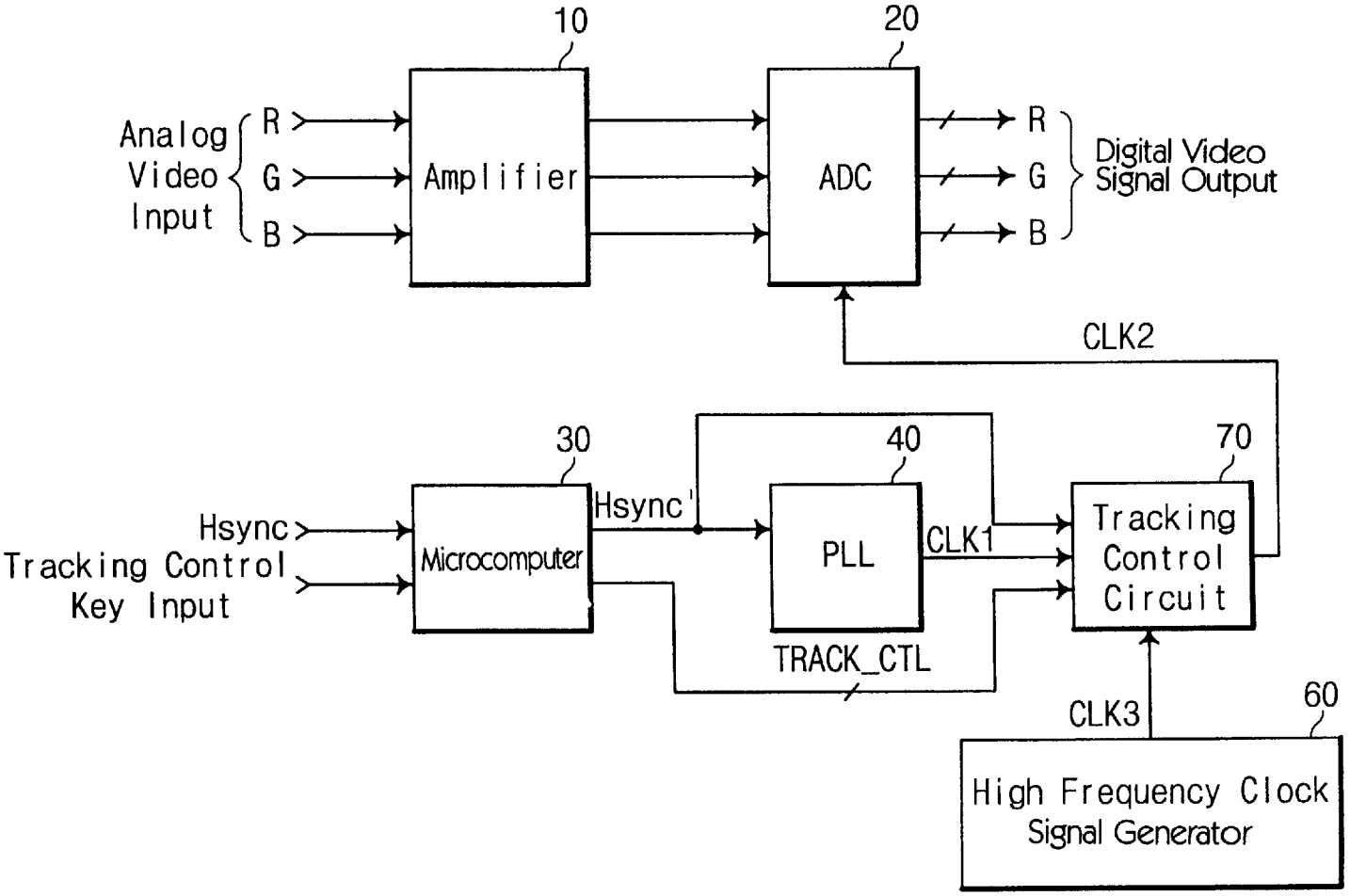
FIG. 4 is a block diagram illustrating a portion of the structure of a flat panel display according to the present invention.

The same reference numerals are used for the corresponding parts of FIGS. 1 and 4. Referring to FIG. 4, the display comprises a clock signal generator 40, an amplifier 10, an A/D converter 20, a microcomputer 30, a high frequency clock signal generator 60, and a tracking control circuit 70. The amplifier 10, A/D converter 20, microcomputer 30 and clock signal generator 40 correspond to those shown in FIG. 1. The high frequency clock signal generator 60 may consist of a high frequency crystal oscillator, and generates a high frequency clock signal CLK3 having a higher frequency than the first sampling clock signal CLK1 of the clock signal generator 40. The tracking control circuit 70 delays the first sampling clock signal CLK1 of the clock signal generator 40 according to the adjustment value of the tracking control data TRACK_CTL to generate a second sampling clock signal CLK2 supplied to the A/D converter 20. The tracking control circuit 70 adjusts the delaying time corresponding to the adjustment value of the tracking control data TRACK_CTL by measuring the present delayed time with the high frequency clock signal CLK3.

Figure 5:
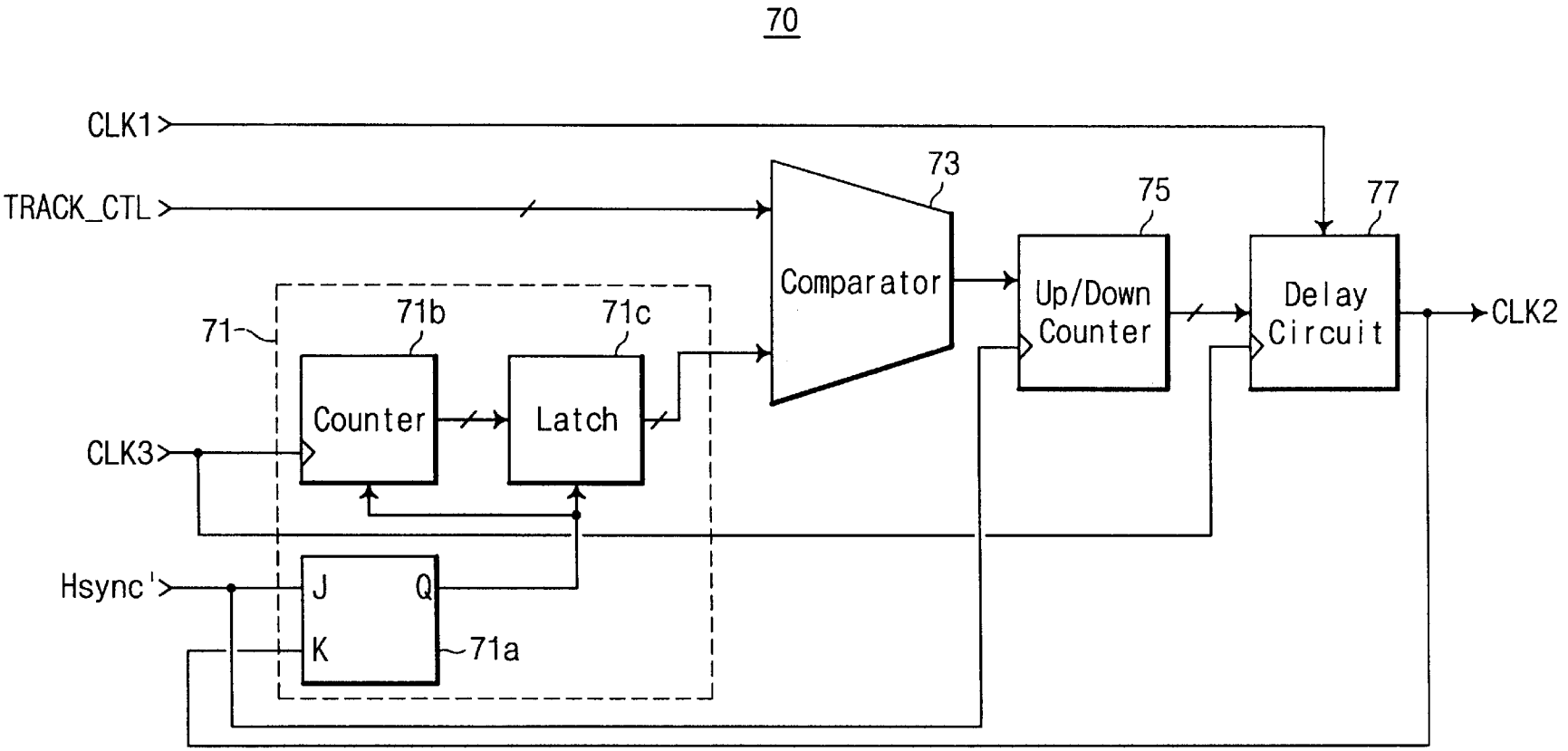
FIG. 5 is a detailed circuit diagram illustrating the tracking control circuit shown in FIG. 4.
Figure 6:
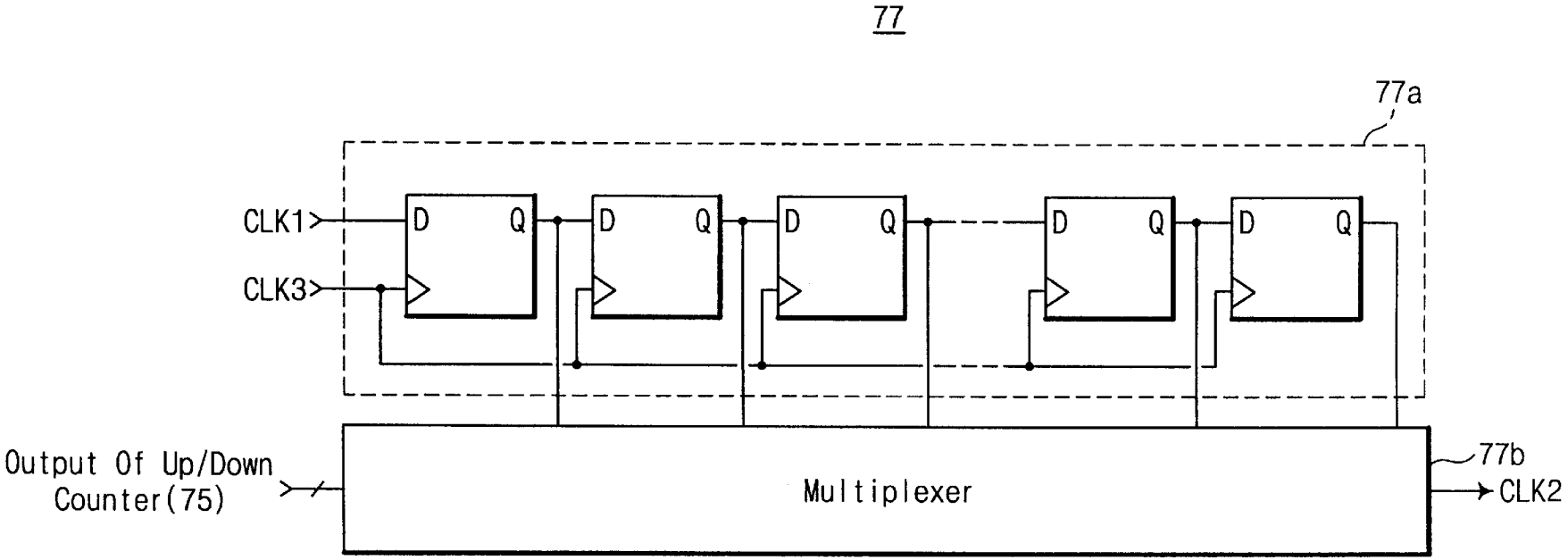
FIG. 6 is a detailed circuit diagram illustrating the delay circuit shown in FIG. 5.
Figure 7:
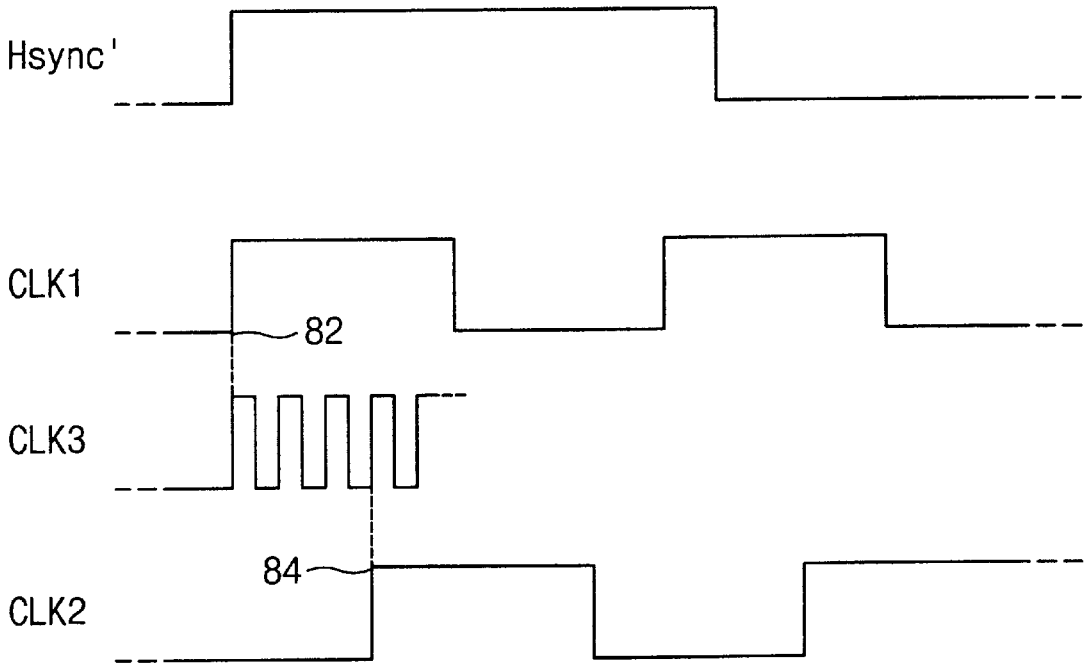
FIG. 7 is a timing diagram illustrating the operation of the tracking control circuit shown in FIG. 5.

Referring to FIGS. 5 to 7, the tracking control circuit 70 specifically includes a delay measurement circuit 71, a comparator 73, an up/down counter 75, and a delay circuit 77. The delay measurement circuit 71 further includes a JK flip-flop 71*a*, a counter 71*b*, and a latch 71*c*. The delay circuit 77 further includes a shift register 77*a* and a multiplexer 77*b*. The JK flip-flop 71*a* receives the horizontal synchronizing signal Hsync' of the microcomputer as a J-input thereof and the second sampling clock signal CLK2 as a K-input thereof to give an output to enable the counter 71*b* and latch 71*c*. The counter 71*b* performs the counting operation in synchronism with the high frequency clock signal CLK3 when receiving the horizontal synchronizing signal Hsync at time point 82 as shown in FIG. 7. The latch 71*c* latches the output of the counter 71*b*. Hence, the phase difference between the first and second sampling clock signals CLK1 and CLK2 is detected.

The comparator 73 compares the phase difference data with the tracking control data TRACK_CTL supplied from the microcomputer 30 to generate a time adjustment signal to increase or decrease the delayed time. The up/down counter 75 counts up or down according to the time adjustment signal to generate a delay data applied to the delay circuit 77. The delay circuit 77 delays the first sampling clock signal CLK1 in response to the delay data to generate the second sampling clock signal CLK2.

For example, assuming that the counted value of the up/down counter 75 be '3' and the value of the tracking control data '5', the operation is as follows:

Since the value measured by the delay measurement circuit 71 is '3', the comparator 73 delivers the adjustment signal to the up/down counter 75 to count up '5' in synchronism with the horizontal synchronizing signal Hsync'. The counted number '5' is supplied to the delay circuit 77, and thus to the multiplexer 77*b*. Hence, the fifth bit output of the shift register 77*a* is selected. Such an operation is repeated to adjust the delayed time of the first sampling clock signal CLK1 corresponding to the tracking control data TRACK_CTL. Conversely, if the delayed time of the delay circuit 77 is greater than the value of the tracking control data TRACK_CTL, the up/down counter 75 counts down to adjust it.

Thus, the inventive tracking control circuit obviates the variation of the prescribed delaying time of the sampling clock signal due to external factors such as heat, so that the analog video signal is correctly converted to the digital video signal.

It should be understood that the present invention is not limited to the particular embodiment disclosed herein as the best mode contemplated for carrying out the present invention, but rather that the present invention is not limited to the specific embodiments described in this specification except as defined in the appended claims.

What is claimed is:

1. A display comprising:

a clock signal generator for generating a first sampling clock signal used for converting an analog video signal supplied from a host to a digital video signal;

a tracking control circuit for generating tracking control data corresponding to a tracking adjustment key input;

an analog-to-digital converter (A/D converter) for converting said analog video signal to said digital video signal in synchronism with a second clock signal output from said tracking control circuit and comprising said first sampling clock signal after being delayed according to said tracking control data;

a high frequency clock signal generator for generating a high frequency clock signal; and said tracking control circuit measuring the presently delayed time of said second sampling clock signal by means of said high frequency clock signal so as to adjust said delayed time according to said tracking control data.

2. The display as defined in claim 1, said tracking control circuit further comprising:

a delay measurement circuit for measuring a phase difference between a horizontal synchronizing signal from said host and said second sampling clock signal by means of said high frequency clock signal to generate phase difference data corresponding to said presently delayed time;

a comparator for comparing said tracking control data with said phase difference data to generate a time adjustment signal for increasing or decreasing said delayed time;

a delay data generator for increasing or decreasing said delayed time according to said time adjustment signal to generate delay data; and a delay circuit for delaying said first sampling clock signal according to said delay data to generate said second sampling clock signal.

3. The display as defined in claim 2, said delay measurement circuit further comprising:

a JK flip-flop for receiving said horizontal synchronizing signal as a J-input thereof and said second sampling clock signal as a K-input thereof;

a counter enabled by an output of said JK flip-flop to perform the counting operation in synchronism with said high frequency clock signal; and a latch enabled by said output of said JK flip-flop to latch a count value of said counter supplied to said comparator.

4. The display as defined in claim 2, said delay data generator further comprising:

an up/down counter for increasing or decreasing said delay data value in synchronism with said horizontal synchronizing signal according to a voltage level of said time adjustment signal.

5. The display as defined in claim 2, said delay circuit further comprising:

a shift register for shifting said first sampling clock signal in synchronism with said high frequency clock signal; and a multiplexer for selecting one output bit of said shift register as said second sampling clock signal according to said delay data.

6. The display as defined in claim 3, said delay data generator further comprising:

an up/down counter for increasing or decreasing said delay data value in synchronism with said horizontal synchronizing signal according to a voltage level of said time adjustment signal.

7. The display as defined in claim 5, said delay data generator further comprising:

an up/down counter for increasing or decreasing said delay data value in synchronism with said horizontal synchronizing signal according to a voltage level of said time adjustment signal.

8. A method of operating a display comprising the steps of:

generating a first sampling clock signal used for converting an analog video signal supplied from a host to a digital video signal;

generating tracking control data corresponding to a tracking adjustment key input;

converting said analog video signal to said digital video signal in synchronism with a second clock signal comprising said first sampling clock signal after being delayed according to said tracking control data;

generating a high frequency clock signal; and measuring the presently delayed time of said second sampling clock signal by means of said high frequency clock signal so as to adjust said delayed time according to said tracking control data.

9. The method of operating a display as defined in claim 8, further comprising the steps of:

measuring a phase difference between a horizontal synchronizing signal from said host and said second sampling clock signal by means of said high frequency clock signal to generate phase difference data corresponding to said presently delayed time;

comparing said tracking control data with said phase difference data to generate a time adjustment signal for increasing or decreasing said delayed time;

increasing or decreasing said delayed time according to said time adjustment signal to generate delay data; and delaying said first sampling clock signal according to said delay data to generate said second sampling clock signal.

10. The method of operating a display as defined in claim 9, further comprising the steps of:

receiving said horizontal synchronizing signal as a J-input thereof and said second sampling clock signal as a K-input thereof;

performing the counting operation enabled by an output of said JK flip-flop in synchronism with said high frequency clock signal; and latching a count value of said counting operation enabled by said output of said JK flip-flop.

11. The method of operating a display as defined in claim 9, further comprising the steps of:

increasing or decreasing said delay data value in synchronism with said horizontal synchronizing signal according to a voltage level of said time adjustment signal.

12. The method of operating a display as defined in claim 9, further comprising the steps of:

shifting said first sampling clock signal in synchronism with said high frequency clock signal; and selecting one output bit of said shifted first sampling clock signal as said second sampling clock signal according to said delay data.

13. The method of operating a display as defined in claim 10, further comprising the steps of:

increasing or decreasing said delay data value in synchronism with said horizontal synchronizing signal according to a voltage level of said time adjustment signal.

14. The method of operating a display as defined in claim 12, further comprising the steps of:

increasing or decreasing said delay data value in synchronism with said horizontal synchronizing signal according to a voltage level of said time adjustment signal.

* * * * *